United States Patent [19]

Franklin, Jr.

[11] 4,248,060

[45] Feb. 3, 1981

[54] $CO_2$ CHARGED COOLING UNIT

[76] Inventor: Paul R. Franklin, Jr., 5211 W. Beaver St., Jacksonville, Fla. 32205

[21] Appl. No.: 59,769

[22] Filed: Jul. 23, 1979

[51] Int. Cl.[3] ..... F25D 3/12

[52] U.S. Cl. ..... 62/387; 62/406; 62/426

[58] Field of Search ..... 62/384, 387, 388, 430, 62/437, 406, 426

[56] References Cited

U.S. PATENT DOCUMENTS

| | | | |
|---|---|---|---|
| 1,901,190 | 3/1933 | Rabe | 62/387 |
| 2,070,044 | 2/1937 | Gilpin | 62/387 |
| 2,107,538 | 2/1938 | Justheim | 62/388 |
| 2,475,755 | 7/1949 | Pearson | 62/384 |
| 2,738,654 | 3/1956 | Elston et al. | 62/388 |
| 3,163,022 | 12/1964 | Hottenroth | 62/388 |
| 3,744,271 | 7/1973 | Franklin, Jr. | 62/430 |
| 3,745,785 | 7/1973 | Crawford et al. | 62/388 |

*Primary Examiner*—Ronald C. Capossela
*Attorney, Agent, or Firm*—Clarence A. O'Brien; Harvey B. Jacobson

[57] ABSTRACT

A vertically elongated upright and closed bottom cabinet is provided including peripherally extending sides. A vertically extending passage structure is disposed within the cabinet inwardly of the peripheral sides thereof and the passage structure is constructed from material having good heat transfer properties and include upper and lower ends opening outwardly of the cabinet. Blower structure is operatively associated with the passage structure for pumping air through the passage structure and inlet structure is provided for admitting $CO_2$ "snow" into the upper end portion of the cabinet about the passage structure for gravity falling of the "snow" within the cabinet toward the closed bottom thereof about the passage structure.

8 Claims, 3 Drawing Figures

$CO_2$ CHARGED COOLING UNIT

BACKGROUND OF THE INVENTION

In various instances it is desired to cool, and maintain cool, the interior of a mobile normally closed and insulated storage area. Such storage areas may comprise the load bodies of trucks utilized to transport perishables.

Although some trucks include mechanical refrigeration units for refrigerating the interior of the load bodies thereof, such mechanically refrigerated load bodies are expensive and frequently experience mechanical failures. In addition, a mechanically refrigerated load body equipped truck is not always available when an urgent need for transporting perishable items arises.

Therefore, a need exists for structure whereby the interior of a normally closed load body may be cooled and maintained in a cooled state.

Although various forms of non-mechanical refrigeration units have been heretofore designed such as that disclosed in my prior U.S. Pat. No. 3,744,271, such non-mechanical refrigeration units, in most cases, utilize liquid nitrogen and the vaporization of the liquid nitrogen to provide the necessary cooling action. However, the cost of liquid nitrogen has recently increased to the point rendering its utilization on a large scale cost prohibitive. Accordingly, a need exists for an improved form of cooling unit, of the cold holdover type, and which may be "charged" at a lower cost.

BRIEF DESCRIPTION OF THE INVENTION

The cooling unit of the instant invention includes a vertically elongated upright closed bottom cabinet including peripherally extending sides and a vertically extending passage structure within the cabinet inwardly of the peripheral sides thereof, the upper and lower ends of the passage structure opening to the exterior of the cabinet. The side walls of the cabinet are downwardly convergent and structure is provided in the upper portion of the cabinet for admitting $CO_2$ "snow" thereinto for gravity falling of the "snow" within the cabinet toward the closed bottom thereof about the passage structure. Air pump structure is operatively associated with the passage structure for pumping air therethrough and the passage structure is constructed of a material having good heat transfer properties. Accordingly, the air pumped through the air passage structure may be cooled by the $CO_2$ "snow" on the exterior of the passage structure inwardly of the sides of the cabinet.

The main object of this invention is to provide a cooling unit (at least semi-portable) which may be utilized in vehicle load bodies for cooling the interior thereof and maintaining the interior of such vehicle load bodies cooled.

Another object of this invention is to provide a cooling unit which may be readily equipped with a thermostatically controlled blower system to thereby render the cooling unit operative to maintain the interior of the associated load body cooled to a predetermined level.

Still another important object of this invention is to provide a cooling unit which may be readily utilized in different types of vehicle bodies.

A further object of this invention is to provide a cooling unit which may have the $CO_2$ "snow" containing portion thereof selectively vented either to the interior of the associated load body or to the exterior thereof.

A final object of this invention to be specifically enumerated herein is to provide a cooling unit which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
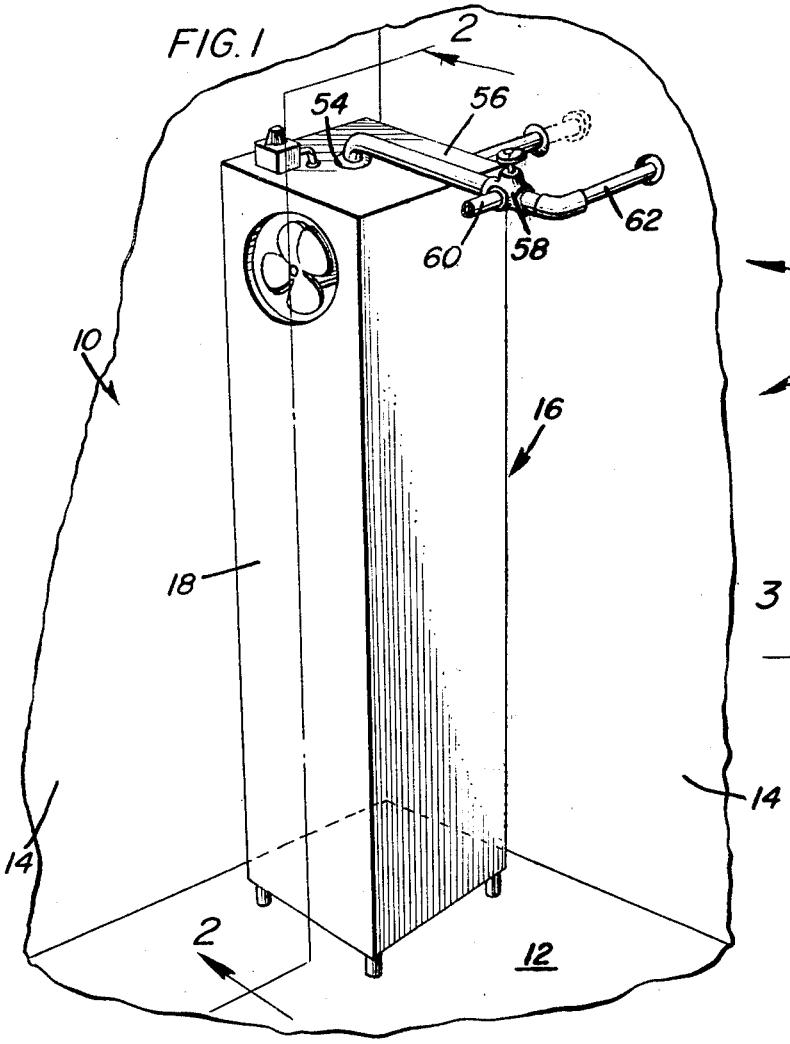
FIG. 1 is a fragmentary perspective view of one corner portion of the interior of a vehicle load body and with the cooling unit of the instant invention operatively mounted within the vehicle body.
Figure 2:
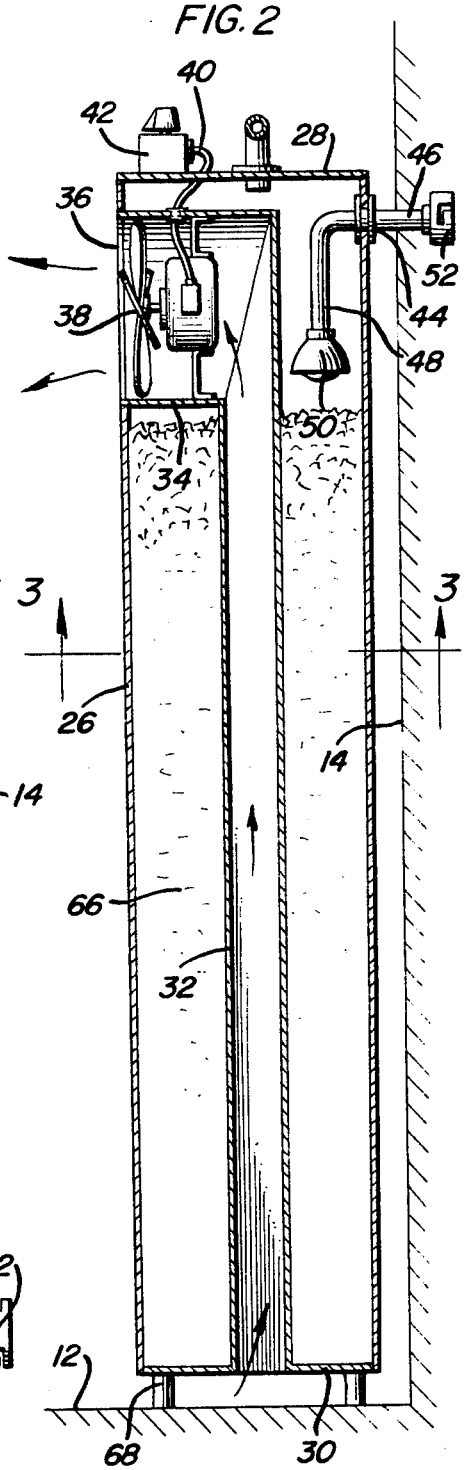
FIG. 2 is an enlarged fragmentary vertical sectional view taken substantially upon the plane indicated by the section line 2—2 of FIG. 1.
Figure 3:
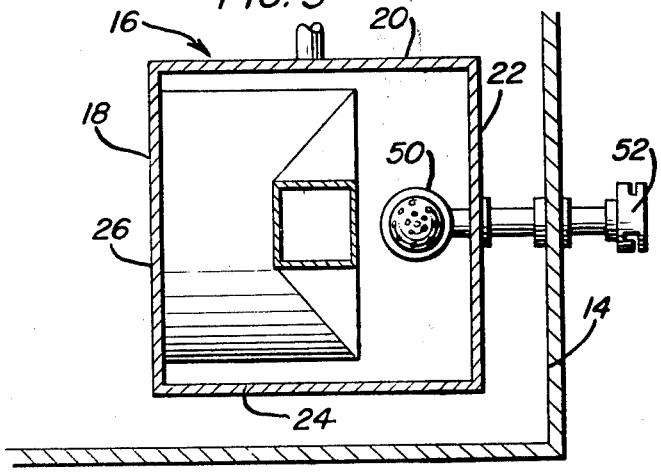
FIG. 3 is an enlarged horizontal sectional view taken substantially upon a plane indicated by the section line 3—3 of FIG. 2.

Referring now more specifically to the drawings, the numeral 10 generally designates a conventional vehicle body such as that which may be used to transport perishable goods and which may be refrigerated. The body 10 includes a floor 12 and upstanding peripheral walls 14. It is to be noted that the body is conventional in design and may be insulated and provided with doors (not shown) for providing access to the interior thereof, the doors normally being closed.

The cooling unit of the instant invention is referred to in general by the reference numeral 16 and comprises a vertically elongated upright cabinet 18 including four similar peripheral walls 20, 22, 24 and 26 interconnected at their upper and lower ends by means of top and bottom walls 28 and 30 extending and secured therebetween in order to define a closed cabinet.

The walls 20, 22, 24 and 26 are planar and each is disposed substantially 90° relative to the adjacent walls whereby the interior of the cabinet 18 is substantially square in horizontal cross section.

The walls 20, 22, 24 and 26 are slightly downwardly convergent, the plan area of the bottom wall 30 being less than the plan area of the top wall 28 and the interior of the cabinet includes an upstanding passage structure 32 which opens downwardly through a central portion of the bottom wall 30 and includes a right angulated upper end portion 34 which opens forwardly through the wall 26 of the cabinet, the wall 26 having an opening 36 therein with which the terminal end of the right angulated portion 34 is registered. The right angulated portion 34 has an electric motor power blower assembly 38 mounted therein for drawing air upwardly through the passage structure 30 and pumping the circulated air outwardly through the opening 36. The blower assembly 38 is electrically connected in a circuit 40, having an adjustable thermostat 42 serially connected therein, electrically connected to any suitable source (not shown) of electrical potential provided on the vehicle of which the load body 10 comprises a part.

The upper portion of the wall 22 of the cabinet 18 has an opening formed therethrough provided with a grommet 44 and an inlet pipe 46 passes through the grommet 44 and has a down turned end 48 thereon inwardly of the cabinet and terminating in a downwardly opening "snow" forming nozzle 50. The pipe 46 extends away from the cabinet 18 through the wall 14 and is provided with a coupling fitting 52 on its terminal end with which a suitable source of $CO_2$ under pressure may be removably coupled.

In addition, the top wall 28 of the cabinet 18 includes an opening formed therethrough provided with a grommet 54 and a vent pipe 56 extends downwardly through the grommet 54 into the interior of the upper portion of the cabinet 18. The vent pipe 56 extends away from the cabinet 18 and has a two-position valve 58 therein through which $CO_2$ gas from the exterior of the cabinet 18 may be selectively vented to a discharge pipe 60 within the load body 10 or through a pipe 62 also opening through the wall 14 to the exterior of the load body 10.

In operation, the cooling unit 16 is charged by the admission of $CO_2$ under pressure into the cabinet 18 through the pipe 46 and nozzle 50. The discharge of $CO_2$ gas from the nozzle 50 forms $CO_2$ "snow" within the cabinet and the "snow" falls by gravity toward the bottom of the cabinet and piles up about the passage structure 32. The passage structure 32 is constructed of a material having good heat transfer properties and the walls 20, 22, 24 and 26 of the cabinet are also constructed of a material having good heat transfer properties. Accordingly, once the interior of the cabinet 18 has been charged with $CO_2$ "snow" 66, the exterior surfaces of the walls 20, 22, 24 and 26 are cooled and air within the load body 10 passes downwardly along those cooled walls for the absorption of heat from the circulating air. Of course, the presence of the chilled cabinet 18 within the load body 10 will serve to provide a minimum cooling action on the interior of the body 10. However, if the cooling action of the exterior surfaces of the walls 20, 22, 24 and 26 is not sufficient to satisfy the thermostat, a rise in temperature of the interior of the load body 10 above the setting of the thermostat 42 will cause the blower assembly 38 to be actuated whereupon air will be pumped upwardly to the passage structure 32 and outwardly through the opening 36 in a manner to rapidly cool the air within the interior of the load body 10. As soon as the temperature within the load body 10 has dropped below the predetermined maximum setting of the thermostat 40, operation of the blower assembly 38 will be terminated.

If the interior of the load body 10 is not to be entered frequently, the valve 58 may be adjusted so that the interior of the cabinet 18 exteriorly of the passage structure 32 will be vented to the interior of the load body 10. In this manner, maximum cooling of the interior of the load body 10 will be achieved. However, if the load body 10 is to be entered and persons therein are to stay a length of time which might their being exposed to excessive amounts of carbon dioxide, the valve 58 may be adjusted so that the interior of the cabinet 18 may be vented to the exterior of the load body 10. Also, it will be noted that the lower end of the cabinet 18 includes four corner depending legs 68 which support the cabinet 18 from the floor 12 in an elevated position in order that circulating air within the load body 10 may enter the lower end of the passage structure 32.

As the circulating air passing downwardly along the exterior surfaces of the side walls of the cabinet has heat absorbed therefrom by the cooled side walls and the "snow" within the side walls of the cabinet vaporizes, the entire quantity of "snow" within the cabinet 18 drops to again place the "snow" into contact with the inner surfaces of the cabinet side walls.

If desired, the entire unit 16 may be exteriorally insulated, mounted on the exterior of the body 10 and have air ducted from and into the interior of the body 10 through the lower end of passage structure 32 and opening 36, the thermostat 42 being retained within body 10 and the pipes 46 and 56 being disposed entirely exteriorally of body 10, but with pipe 60 opening into the interior of body 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A precharged cooling unit for use in a normally enclosed insulated area to be maintained cool, said cooling unit including an upright closed bottom cabinet having peripherally extending sides, vertically extending passage structure within said cabinet inwardly of the peripheral sides thereof, said passage structure being constructed of a material having good heat transfer properties, including open upper and lower ends and defining an internal passage extending therethrough including at least a major length portion thereof which is substantially vertically straight and constant in cross-sectional area for minimal restriction to the passage of air therethrough, blower means operatively associated with said passage structure for pumping air therethrough, and charging means for admitting $CO_2$ "snow" into the upper portion of said cabinet outwardly of said passage structure for gravity falling of "snow" within said cabinet toward the closed bottom thereof about said passage structure, said peripherally extending sides being slightly downwardly convergent.

2. The combination of claim 1 wherein the upper end of said cabinet is closed.

3. The combination of claim 2 wherein the upper portion of said cabinet includes a vent communicating the interior of said cabinet outwardly of said passage structure with the exterior of said cabinet.

4. The combination of claim 3 wherein the upper end of said passage structure includes a right angulated terminal end opening outwardly through the upper portion of one of the peripheral walls of said cabinet.

5. The combination of claim 4 wherein said side walls are constructed of a material having good heat transfer properties.

6. The combination of claim 1 wherein the lower end of said passage structure opens downwardly through the closed bottom of said cabinet, said bottom of said cabinet including depending support legs for supporting the bottom of said cabinet above a horizontal surface upon which the support legs of said cabinet rest.

7. The combination of claim 6 wherein said passage structure includes an angulated upper end portion opening outwardly through one of said side walls of said cabinet adjacent but spaced below the upper end thereof.

8. The combination of claim 7 wherein said blower means is operative to circulate air through said upstanding passage in an upward direction.

* * * * *